US006378994B1

(12) United States Patent
Ueda et al.

(10) Patent No.: US 6,378,994 B1
(45) Date of Patent: Apr. 30, 2002

(54) LIQUID JET PRINTING HEAD AND METHOD FOR MANUFACTURING THE SAME

(75) Inventors: Yoshihisa Ueda; Koji Ikegami; Masaki Kataoka; Kazuyuki Oda; Toshinobu Hamazaki; Koichi Saitoh; Kohzo Hara; Kenji Yamazaki; Norikuni Funatsu; Takayuki Takeuchi; Kunihito Satou; Ichiro Tomikawa; Tomoki Umezawa; Michiaki Murata, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/650,668

(22) Filed: Aug. 30, 2000

(30) Foreign Application Priority Data

Mar. 8, 2000 (JP) ..... 2000-064089

(51) Int. Cl.[7] ..... B41J 2/05
(52) U.S. Cl. ..... 347/65
(58) Field of Search ..... 347/65, 92, 47, 347/63, 64, 20, 56, 54

(56) References Cited

U.S. PATENT DOCUMENTS 4,723,129 A * 2/1988 Endo et al. ..... 347/56
4,774,530 A * 9/1988 Hawkins ..... 347/63
5,665,249 A 9/1997 Burke et al. ..... 216/2

FOREIGN PATENT DOCUMENTS

| | | | |
|---|---|---|---|
| JP | 1-148560 | 6/1989 | ..... B41J/3/04 |
| JP | 5-84917 | * 4/1993 | ..... 347/63 |
| JP | 5-338168 | 12/1993 | ..... B41J/2/05 |
| JP | 5-338177 | 12/1993 | ..... B41J/2/05 |
| JP | 8-11866 | 5/1996 | ..... B41J/2/16 |
| JP | 8-118653 | 5/1996 | ..... B41J/2/05 |
| JP | 9-226142 | 9/1997 | ..... B41J/2/175 |
| JP | 11-227208 | 8/1999 | ..... B41J/2/05 |

* cited by examiner

*Primary Examiner*—John Barlow
*Assistant Examiner*—Juanita Stephens
(74) *Attorney, Agent, or Firm*—Morgan, Lewis & Bockius LLP

(57) ABSTRACT

The present invention provides a liquid jet printing head, a method of manufacturing the same, and a liquid jet printing apparatus, which allow stable, high speed, and continuous printing. A liquid jet printing head provides an inflow of liquid from an inlet to a common chamber, then along with the surface of heating elements of a heating element substrate and with a wall of a housing to separate channels. Liquid drops will be ejected by heating the heating elements. Since liquid may flow linearly from the inlet to the separate channels in accordance with the present invention, smooth flow promotes evacuation of bubbles through a nozzle, while cooling the heating element substrate with liquid flowing along with the substrate. The present invention provides thereby stable printing with high speed, continuous ejection (printing) of liquid drops.

28 Claims, 15 Drawing Sheets

LIQUID JET PRINTING HEAD AND METHOD FOR MANUFACTURING THE SAME

BACKGROUND OP THE INVENTION

1. Field of the Invention

The present invention is directed to a liquid jet type recording head, a method for manufacturing the same, and a liquid jet type recording apparatus, and more specifically to a liquid jet type recording head used in a thermal type liquid ejector apparatus capable of continuously and stably jetting (printing) liquid at high speed, a method of manufacturing the same, and a liquid jet type recording apparatus using the same.

2. Description of the Related Art

Recently, the liquid jet recording apparatus has attracted a great deal of public attention because of its nature as a low-cost and high quality color recording apparatus. Exemplary liquid jet recording heads for use in the liquid jet recording apparatus includes, for example, a piezo-electric liquid jet recording head for jetting liquid through nozzles with the pressure generated by the mechanical distortion of pressure chamber by a piezo-electric element, and a thermal type liquid jet recording head for jetting liquid through nozzles with the pressure generated by evaporation of liquid by applying current to heating elements each of which is individually arranged in a separate channel.

There are some known ink jet printing heads in the Prior Art. Japanese Published Unexamined Patent Application No. Hei 9-226142 discloses the prevention of bubbles by providing an ink supplying channel having smaller cross-sectional area than the cross section of opening of the common ink chamber for an ink supplying channel to the common ink chamber communicating with the head orifice of the printing head. Japanese Published Unexamined Patent Application No. Hei 11-227208 discloses narrowing in the vertical direction the inner walls of head in the proximity of nozzles and liquid inlet within each orifice in the recording head to improve the ink supply. Japanese Published Unexamined Patent Application No. Hei 1-148560 discloses a method of creating an ink jet recording head by compiling a first substrate having ink channels and a common chamber formed by anisotropic etching on a surface side of silicon wafer, and a second substrate having heating elements and addressing electrodes formed on a surface side of silicon wafer. Japanese Published Unexamined Patent Application No. Hei 5-338177 discloses a printing head with a fitting arrangement of an ink manifold used as the common liquid chamber of recording head with an ink reservoir, having the back end wall of ink manifold formed as a sharp edge. Japanese Published Unexamined Patent Application No. Hei 5-338168 discloses a method of removing bubbles in a reservoir by forming an ink supplying lid of parallelogram to an ink reservoir of a printing head made of a silicon substrate. Japanese Published Unexamined Patent Application No. Hei 8-118666 discloses an ink jet recording head by forming an ink jet recording head chip by bonding plural silicon substrates, removing a part of one of silicon substrates of the head chip, and providing a common ink chamber having an ink supplying opening at the removed part. Japanese Published Unexamined Patent Application No. Hei 8-118653 discloses a method of improving the adhesiveness between silicon substrates in an inkjet printing head having two patterned silicon substrates bonded together by an intermediate thick film of a polymer by flattening by chemically or mechanically polishing the intermediate thick film layer of the ink jet printing head.

An example of the thermal type liquid jet recording head of the state of the art is disclosed in the Japanese Published Unexamined Patent Application No. Hei 9-226142. Now referring to FIG. 20, there is shown a perspective view of a liquid jet recording head and a liquid supplier incorporated in a liquid jet recorder of the Prior Art. FIG. 21 depicts a cross-sectional view of the head shown in FIG. 20 taken along with the line A—A.

A head chip 100 has plural channels 102 formed in parallel at a predetermined distance, and an ink outlet 104 is outwardly opened at an end of each channel 102. The other end of each of plural channels 102 is communicated with a commonly shared ink chamber 106. At the top of ink chamber 106 an opening 108 is formed for supplying liquid thereto. In each of channels 102 a heating element 110 is disposed, which generates heat to foam the liquid in the channel 102, and the pressure generated by the foamed liquid forces the liquid to eject through the ink outlet 104 for recording.

The head chip 100 as has been described above may be formed by bonding a heating element substrate 114 with heating elements 110 mounted thereon and a channel substrate 116 having grooves formed for the channels 102 and the common ink chamber 106, with the aid of a resin layer (not shown in the figure).

The heating element substrate 114 is affixed to a heat sink 118 for effective radiation of heat. On the heat sink 118 is formed a printed circuitry to transfer power and signals supplied from the liquid jet recorder through the bonding wires 120 to the heating element substrate 114 and to feed back signals generated by a variety of sensors incorporated in the heating element substrate 114 to the recorder.

On the head chip 100, a liquid supplier member 122 is bonded. The liquid supplier member 122 includes liquid channels 124 for supplying liquid from a liquid reservoir (not shown) to the head chip 100.

The liquid jet recording head thus formed will be supplied with liquid from the liquid reservoir through the separate channels 102. In other words, the liquid supplied from the reservoir will flow through the liquid channels 124 of the liquid supplier member 122, then through the liquid inlet 108 opened on the top of the channel substrate 116 of the head chip 100 to the common chamber 106, in order to supply ultimately to each of the separate channels 102.

In a liquid jet recording head as has been described above has a disadvantage that some bubbles will be intermixed with the liquid when introducing the liquid from the liquid reservoir to the liquid chamber 106. The bubbles mixed therein along with the liquid tend to reside intensively in the area 126 (see FIG. 21) in the liquid chamber 106 where the liquid flow is slow. In case where bubbles reside in the chamber 106 for example, the bubbles will grow larger while repeatedly jetting the liquid so as to interfere the supply of liquid by blocking channels 102, to ultimately cause the defects of recording. In the thermal type of liquid jet recording heads, the temperature of liquid will increase with the heating of heating element 110. As the result of heating the air dissolved in the liquid, bubbles will be deposited in the common chamber 106 and enlarged to be likely to prevent smooth ejection of liquid drops therefrom. In this manner, heating may develop bubbles in the common chamber 106 as well as in the junction of the common chamber 106 with the liquid supplier member 122, resulting in a problem of blocking by bubbles.

In order to purge bubbles residing in the common liquid chamber, it is common to aspirate through the nozzles 104.

When sucking bubbles through the nozzles 104, an amount of liquid equivalent to the volume sucked will be supplied from the reservoir. Thus supplied liquid will spread along with the shape of the common liquid chamber 106 to be directed to the separate channels 102. The liquid flow may force bubbles to advance toward the channels 102 to purge from the nozzles 104. However, the bubbles residing at both ends of the chamber 106, at the ends shown by the arrow in the direction of X, which are the primary cause of defects in the printing quality, are difficult to be completely removed because these bubbles are in the area of very slow flow of liquid.

In order to remove bubbles residing at both ends of the chamber 106 as has been described above, in the liquid jet recording heads of the Prior Art, dummy nozzles 126 have to be provided at both ends of the chamber 106, which nozzles are not for use in printing.

Although it is conceivable to increase the number of times of aspiration through nozzles, there will arise problems that a higher frequency of aspiration cleaning decreases the effective efficiency of liquid for use in recording, and requires a larger volume of a waste liquid container for containing aspired waste liquid, resulting In a larger apparatus in size.

In a thermal type liquid jet recording head, there is another problem that high speed and continuous printing cannot be performed. This is because when ejection (recording) is continuously performed, the temperature of head assembly increases to ultimately disable the stable ejection of liquid.

SUMMARY OF THE INVENTION

In order to avoid this phenomenon, finer control of printing such as stopping printing at or beyond a predetermined temperature threshold or slowing the speed of printing by monitoring the temperature of the head will be required.

The present invention has been made in view of the above circumstances and provides a liquid jet printing head, a method of manufacturing the same, and a liquid jet recording apparatus using the same.

In order to solve the above mentioned problems, the present invention provides a liquid jet printing head for jetting liquid by heating with a heater member, includes: a common liquid chamber having an inlet opening for supplying liquid from outside; and plural separated channels for heating liquid supplied through the chamber with the heating elements to eject the liquid through outlets; a heating element substrate incorporating plural heating elements; wherein the liquid supplied from the inlet flows through linearly to the outlet, and wherein the heating element substrate is arranged along with the flow of the liquid.

Now the function of an aspect of the present invention will be described in greater details below.

The liquid that has reached to the common chamber through the inlet will flow through each of separate channels, be heated by heating elements each provided for a channel, and ejected as liquid drops due to the pressure of bubbles generated by heating. The liquid that has flowed through the common chamber from the inlet will be introduced linearly to the channels along with the surface of heating elements formed on the heating element substrate so as to be ejected through the outlet. Because a smooth flow of liquid from the inlet through the channel is achieved, bubbles created in the separate channels or in the chamber will be evacuated smoothly to the atmosphere together with the liquid drops. By arranging the ejection of liquid in the direction of gravity, the bubbles generated will move to the top of common chamber, then through the inlet to the liquid reservoir. This arrangement will prevent the ejection of liquid from being blocked by residing and growing in the proximity of separate channels and by finally occluding separate channels.

Since the liquid flows through along with the surface of heating elements formed on the heating element substrate, the substrate will be effectively cooled down by the liquid so as to be able to suppress the increase of temperature in the heating element substrate.

Therefore a stable, high speed, continuous liquid jet (printing) will be performed.

Another aspect of the present invention is characterized in that a liquid jet printing head further includes a guiding surface for driving the liquid that flows through the common chamber to the separate channels.

Now the function of the present invention will be described in greater details below.

A guiding surface is formed from the common chamber to the channels, so that the liquid will flow there through smoothly. This ensures that the bubbles generated in the common chamber will not remain in the chamber and will be securely ejaculated through the channels.

Another aspect of the present invention is characterized in that a liquid jet printing head further includes a guide plate provided for narrowing the cross section of path toward the channels.

The function of the invention will be described in greater details below.

A guide plate is provided for narrowing the cross section of flow path from the common chamber toward the separate channels, thereby the flow of liquid entering from the common chamber to the separate channels will be accelerated. This allows the liquid flow entering to separate channels to be smoother, resulting in easier evacuation of bubbles generated in the common chamber or separate channels, in other words secure prevention of residual bubbles in the proximity of separate channels. In addition this promotes cooling of the heating element substrate so as to enable more effective control of temperature increase.

Still another aspect of the present invention is characterized in that, in a liquid jet printing head, the cross section of path formed by the guide plate and the substrate is gradually diminished in the direction toward the separate channels.

The function of the invention will be description in greater details below.

The decrease in cross section of the path formed by the guide plate and the substrate toward the separate channels causes the liquid to flow faster toward the channels, thereby the bubbles generated in the proximity of channels will be easily removed and the blocking of liquid jet will be prevented.

Another aspect of the present invention is characterized in that in a liquid jet printing head in accordance with the present invention, a liquid element substrate is arranged so as to contact liquid in the surfaces other than that of forming the heating elements in the heating element substrate.

The function of the invention will be described in greater details below.

In the present invention, a heating element substrate arranged so as to contact liquid in other surfaces in addition to the surface having heating elements may increase radiation of the heating element substrate, allowing more effective control of temperature increase caused by the heating of the heating elements. Thus more stable liquid jet may be achieved even when continuous, high-speed liquid jet is required.

Another aspect of the present invention is characterized in that a liquid jet printing head further includes a structure incorporating the separate channels together with the common chamber.

The function of the aspect of the present invention will be described in greater details below.

Separate channels incorporated with the common chamber enables the decrease in the number of parts as well as miniaturization of printing head.

If the respective separate channels are directly communicate with the common liquid chamber, bubbles remaining in the common chamber will effectively diminished because so-called dead circulate portion of the liquid in the chamber and thus, to ensure the ejection of the liquid droplet from the outlets. Also, the common chamber has relatively high volume compare to the conventional one, contacting area of the heating element substrate with the liquid will be drastically increased, and thus the heat energy generated by the heating element will be effectively released through the liquid. The heat energy released into the liquid also generate the circulate of the liquid for diminishing the temperature of the substrate.

Another aspect of the present invention is characterized in that a liquid jet printing head including input/output terminals of electric signal mounted on the surface of the heating element substrate is positioned at an end of the heating element substrate in the direction orthogonal to the direction of liquid jet.

Now the function of the invention will be described below.

In the present invention, input/output terminals of electric signals are arranged at an end of the heating element substrate in the direction orthogonal to the direction of liquid jet. The inlet of the common liquid chamber, which may be referred as a sub ink tank, may be thereby designed inline toward the separate channels. As a result, more smooth flow may be achieved with input/output terminals of electric signals arranged on the heating element substrate.

Another aspect of the present invention is characterized in that a liquid jet printing head having the surface of the heating element substrate forming the separate channels and coated by a liquid resistant resin layer, includes a liquid resistant and high thermal conductive material deposited at least on a portion of the surface of the heating elements in the heating element substrate, and a resin layer deposited on the surface of the heating elements or on the top of the high thermal conductive material such that a part of the high thermal conductive material is exposed, wherein the liquid comes in contact with the high thermal conductive material.

The function of the invention will be described below.

By depositing a film of liquid resistant resin on the heating element substrate, the corrosion of heating element substrate by the liquid will be prevented. However, coating by a resin layer will decrease the heat radiation from the heating element substrate to the liquid hence promotes the increase of temperature in the heating element substrate. Therefore, by depositing a liquid resistant and high thermal conductive material to at least on a portion of the heating element substrate and exposing a portion of the high thermal conductive material to the liquid to come in contact therewith, the heat generated in the heating element substrate will be effectively conducted to the liquid through the high thermal conductive material. In other words, in accordance with the present invention, the increase of temperature in the heating element substrate will be sufficiently controlled so as to enable stable, high speed, and continuous liquid jet.

Another aspect of the present invention is characterized in that a liquid jet printing head further includes plural openings in the resin layer for exposing the high thermal conductive material.

The function of the invention will be described below.

In order to promote heat radiation from the heating element substrate to the liquid, it may be needed to increase the exposed surface area of the high thermal conductive material. This means that larger area of opening in the resin layer is better. However, when polishing for flattening the surface of the resin layer, there may arise a problem that some abrasive may penetrate into the opening, and the area in proximity of the opening may be locally polished. In accordance with the present invention, there are plural openings provided; the polishing of resin layer may be entirely leveled to increase the radiation.

Another aspect of the present invention is characterized in that a liquid jet printing head further includes the openings of the same shape as the holes provided in the resin layer for exposing the heating elements.

The function of the invention will be described below.

The openings, which have the same shape as the holes formed in the resin layer in order to expose the heating elements, may further level the polishing of the resin layer.

Another aspect of the present invention is characterized in that a liquid jet printing head further includes the openings arranged in a staggered pattern.

The function of the invention will be described below.

The staggered pattern of the openings allows the polished state of resin layer to be further leveled.

Another aspect of the present invention is characterized in that a liquid jet printing head, further includes a liquid resistant and high thermal conductive material disposed on the surface of heating elements on the heating element substrate to provide a wavy ramp surface.

The function of the invention will be described below.

Disposing a liquid resistant and high thermal conductive material on the surface of heating elements on the heating element substrate so as to provide a wavy ramp surface causes the surface area of the high thermal conductive material to be increased and causes the heat radiation of the heating element substrate to be improved.

Another aspect of the present invention is characterized in that a liquid jet printing head further includes the ramp of the high thermal conductive material exceeding a reference value being coated by the resin layer.

The function of the invention will be described below.

The portion with the ramp exceeding a reference value in the high thermal conductive material having a wavy ramp surface is not suitable for the deposition of the high thermal conductive material at a predetermined thickness. Therefore such a portion may have a potential risk of corrosion of the heating element substrate when contacting with the liquid. Therefore, by depositing a resin layer on the high thermal conductive material on the area where the thickness exceeds a reference value, the corrosion of the high thermal conductive material by the liquid in the defective deposition points of high thermal conductive material occurred in such area can be effectively prevented.

Another aspect of the present invention is characterized in that a liquid jet printing apparatus includes a liquid jet printing head in accordance with the present invention.

The function of the invention will be described below.

When using the liquid jet printing head in accordance with an aspect of the present invention, a liquid jet printing apparatus may perform stable liquid jet without the fear of bubbles generated. Also the heat radiation from the heating element substrate to the liquid will be prompted so that the increase of temperature in the heating element substrate may be well controlled so as to be able to continuously eject.

Another aspect of the present invention is characterized in that a liquid jet printing apparatus further includes the liquid jet printing head arranged so as to eject liquid in the angular range between the gravity direction and up to 45 degrees with respect to the gravity direction.

The function of the invention will be described below.

When a liquid jet printing head is arranged to eject liquid in the angular range between the gravity direction and 45 degrees from the gravity direction, the path from the inlet of a common chamber to the ink outlet should be accordingly disposed in the range between the gravity direction and 45 degrees from the gravity direction. Thus the bubbles generated in separate channels or the common chamber may displace toward the inlet of the common chamber. This may prevent the liquid jet through the separate channels from being affected.

Another aspect of the present invention is characterized in that a method of manufacturing a liquid jet printing head having a liquid channel substrate forming separate channels for jetting liquid and a portion of a common chamber for supplying liquid to the separate channels, in accordance with any one aspect of the present invention, wherein the liquid path substrate is made of a silicon substrate, on which grooves are formed for providing the separate channels and the common chamber by using either a crystalline anisotropic etching method or anisotropic etching method.

The function of the invention will be described below.

By forming grooves by either crystalline anisotropic etching or anisotropic etching of a silicon substrate, a portion of separate channels and a common chamber may be formed on a liquid path substrate at high precision.

Another aspect of the invention is characterized in that a method of manufacturing a liquid jet printing head includes a first step of etching a first surface of the liquid path substrate to provide grooves forming a portion of the separate channels and the common chamber, and a second step of processing the substrate from a second surface opposing to the first surface to decrease the thickness of the substrate to pierce there through the groove for a portion of the common chamber.

The function of the invention will be described below.

In general, a portion (pierced throughhole) of the common chamber of the path substrate is formed before forming the separate channels. Care should be taken for handling a path substrate on which the throughhole is formed at the time of forming separate channels; otherwise the substrate will be damaged. In the present invention, the process of forming separate channels is performed at the same time of process of grooves for a portion of the common chamber, and thereafter a portion of the common chamber may be pierced by for example grinding, as the final process of path substrate. This prevents the substrate from being damaged.

When forming throughhole on the path substrate prior to forming of separate channels, cooling gas for the channel process may be leaked from the second surface to the first surface, causing some degradation of process quality and precision of the separate channels. In accordance with the present invention, the quality and precision of process of separate channels may be improved by piercing a portion of common chamber by decreasing the thickness of substrate from the second surface side after the process of separate channels.

Another aspect of the present invention is characterized in that in a method of manufacturing a liquid jet printing head in accordance with the present invention, the second process step is performed after bonding the liquid path substrate and heating element substrate.

The function of the invention will be described below.

The liquid path substrate and heating element substrate will be bonded together after forming grooves for the separate channels and the like in the first surface side. Thereafter, a portion forming a common chamber will be pierced through the substrate by piercing therethrough from the second surface side of the liquid path substrate. In this manner, since the throughhole portion will be formed by processing from the second surface side after increasing the rigidity of the liquid path substrate by bonding the liquid path substrate with the heating element substrate, defects of substrates can be securely prevented.

Another aspect of the present invention is characterized in that a method of manufacturing a liquid jet printing head in accordance with any one of aspects provided by the present invention includes a heating element substrate incorporating heating elements, the heating element substrate being integrated with heating elements and driver circuits on the surface thereof by means of semiconductor manufacturing technique.

The function of the invention will be described below.

Forming heating elements and driver circuits integrated on a substrate may facilitate the forming process as well as improve the reliability of signal processing.

Additional features and advantages of the invention will be according to part in the description which follows and in part will be obvious from the description, or may be learned by practice of the invention. The above mentioned and other features and advantages of the invention may be implemented and attained by means of the instrumentalities and combinations particularly pointed out in the appended claims.

BRIEF DESCRIPTION OF THE DRAWINGS

The accompanying drawings, which are incorporated in and constitute a part of this specification illustrate some embodiments of the invention and, together with the description, serve to explain the objects, advantages and principles of the invention. In the drawings.

DETAILED DESCRIPTION OF THE PREFERRED EMBODIMENTS

A detailed description of some preferred embodiments embodying the present invention will now be given referring to the accompanying drawings.

(First Embodiment)

Figure 1A:
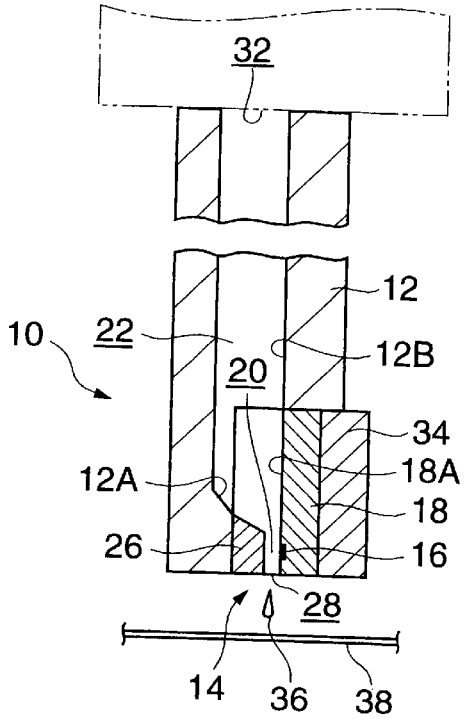
FIGS. 1A to 1C are cross-sectional views of a liquid jet printing head in accordance with a first preferred embodiment of the present invention.

A liquid jet printing head in accordance with the first preferred embodiment of the present invention will be described hereinbelow in greater details with reference to FIG. 1A to FIG. 3. FIG. 1A is a cross-sectional drawing of a liquid jet printing head in accordance with this preferred embodiment, FIG. 2 is a perspective view of a head chip constituting part of the liquid jet printing head, and FIG. 3 is an enlarged view of part of FIG. 1A.

A liquid jet printing head 10 including a head chip 14 fixed at the tip of a housing 12, as shown in FIG. 1A.

Figure 2:
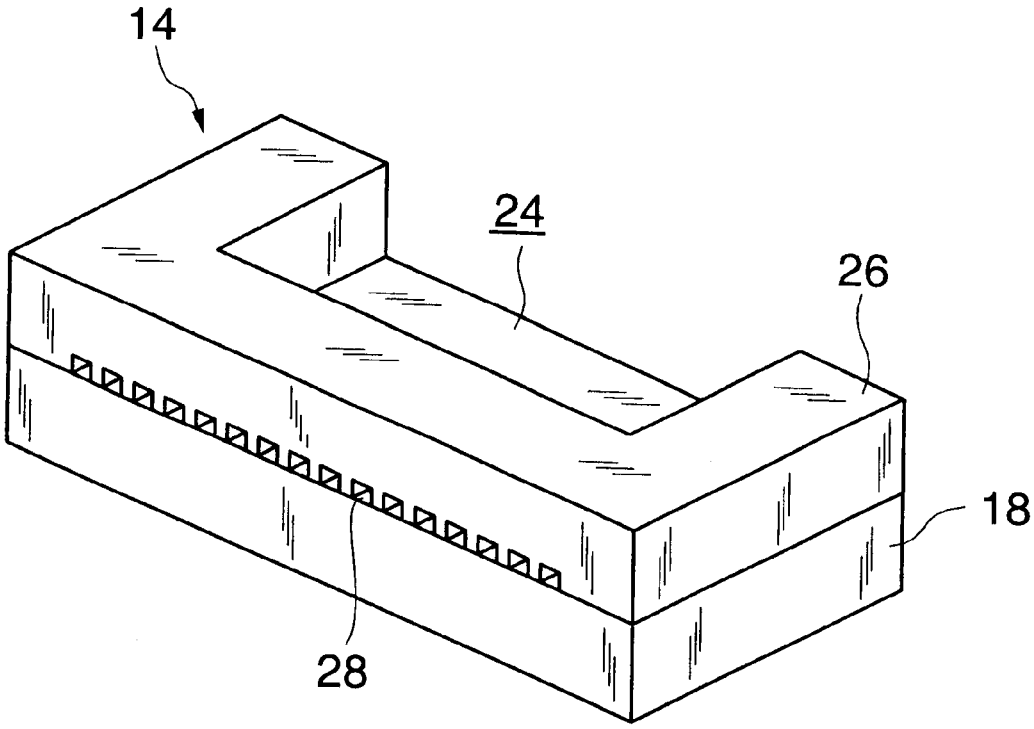
FIG. 2 Is a perspective view of a head chip in accordance with the first preferred embodiment of the present invention.
Figure 3:
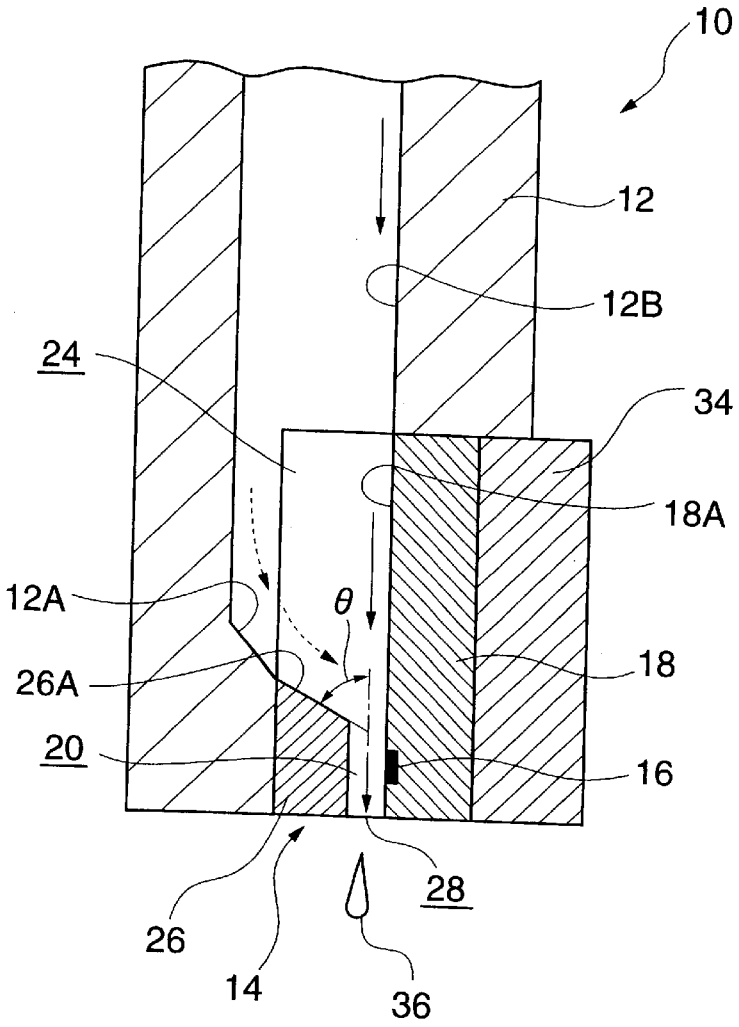
FIG. 3 is an partial enlarged view of FIG. 1.

The head chip 14 includes a heating element substrate 18 having heating elements 16 formed thereon, bonded to a liquid path substrate 26 having a groove 24 constituting part of a common chamber 22 by integratedly joining grooves for separate channels 20 and the housing 12, as shown in FIGS. 2 and 3.

The heating element substrate 18 may be made by means of an apparatus and a method of manufacturing LSIs and the like. For example, a heat storage layer such as silicon oxide is formed on the surface of single crystalline silicone to form thereon the heating elements 16. Plural heating elements 16 may be formed and connected to signal lines for supplying power and signals thereto, The heating elements 16 may be heated by receiving signals supplied from a driver circuit arranged in the same chip or elsewhere. On top of the heating elements 16 a protective layer includes a single layer or plural layers of silicon oxide, silicon nitride, tantalum, etc. for protection the heating elements 16.

A resin layer will be coated thereon, which may be served as a protector film for protecting from liquids. The resin layer may be formed by applying a photosensitive resin and patterning in a photolithographic process. Any of photosensitive resins including for example photosensitive polyimide may be used. Any other polymer materials in addition to photosensitive polyimide may also be used, including for example non-photosensitive polyimide and dry-films. Before patterning the resin layer, the resin on the heating elements and signal electrodes should be removed.

The resin layer will be shrunk in the process of thermosetting so that edges of resin layer being patterned will become a convex shape. The circumference of the substrate will also have a convex shape due to a thick resin layer formed thereon. Such a convex shape may cause defective bonding when bonding to the liquid path substrate 26. In order to remove such convex shape, the resin layer should be flattened by means of such a method as CMP (chemical mechanical polishing).

The liquid path substrate 26 may be formed by means of an apparatus and a method of manufacturing LSIs and the like. For example, a single crystalline silicone may be crystalline anisotropically etched to form grooves for the common chamber 22 and separate channels 20. The crystalline anisotropic etching may be performed such that an etching mask is patterned on a silicon wafer having the crystal face (100) on the surface and the wafer is etched by using warmed aqueous solution of potassium hydroxide (KOH) and the like. Suitable etching solutions include solution of tetra-methyl ammonium hydroxide (TMAH). As an alternative, a method disclosed in Japanese Published Unexamined Patent Application No. H11-227208 may be used instead.

The heating element substrate 18 and liquid path substrate 26 thus formed may be registered and bonded, then cut and separated as a head chip 14. In this manner the liquid path extending from the common chamber 22 through separate channels 20 to the nozzle 28 may be formed.

Then the heating element substrate 18 will be mounted on a heat sink 34 for radiating heat generated by the heating elements 16. A wiring substrate not shown in the figure may be formed on the heat sink 34 to connect to the signal terminals on the head chip 14 through bonding wires.

Then, the head chip 14 will be mounted in the housing 12 so as to form a common chamber 22. The common chamber 22 is formed in a shape of rectangle, provides an inlet 32 for introducing liquid therein from a liquid reservoir, which may be referred as main ink tank, on a side opposing to the head chip 14, and communicates with the other end of each of separate channels 20 through a concaved recess 24 of the head chip 14 (liquid path substrate 26).

By arranging the surface of wall 12B of the housing 12 in succession to the surface 18A of heating element substrate 18, the liquid introduced to the common chamber 22 from the inlet 32 will flow through the wall 12B and the surface 18A of the heating element substrate to the separate channels 20 (see the solid line with an arrow shown in FIG. 3).

At the side of separate channels 20 in the common chamber 22 a guide surface 26A may be formed, which is at an acute angle (θ) in the direction opposed to the liquid jet, so as to smoothly introduce the liquid in the common chamber 22 into the separate channels 20 (see the broken line with an arrow shown in FIG. 3).

The function of thus formed drop ejection recording head 10 will be described below.

Liquid will be supplied from a reservoir not shown in the figure, introduced into the common chamber 22 through the inlet 32, and then distributed to each of separate channels 20. The pressure of bubbles developed in the separate channels 20 by heating the heating elements 16 in the separate channels 20 forces liquid drops 36 to eject from the channels to print on a recordable medium 38.

In the preferred embodiment, liquid introduced from the inlet 32 to common chamber 22 will smoothly enter the separate channels 20 along with the wall 12B of the housing 12 and with the surface of heating elements 18A of the heating element substrate 18. The liquid will flow smoothly there into, guided by the guide surface 26A of the liquid path substrate 26 disposed at an angle θ (approximately <90 degrees) in the direction opposing to the ejection direction of liquid drops 36. As there is no region, where liquid flows extremely slow, observed in a conventional structure of printing head (dead water region), either in the common chamber 22 or in the separate channels 20, there is no space for retaining bubbles if some bubbles accidentally introduced along with the supplied liquid, or for example if bubbles residual in the liquid are developed due to increased temperature of liquid in the common chamber 22 by heating the heating elements 16, and the smooth flow of liquid as mentioned above will evacuate through the nozzle 28 to the outside. Accordingly, interference to the liquid supply to the nozzle 28 (separate channels 20) caused by the development of bubbles will be prevented to ensure a stable printing capability (drop ejection performance).

If the direction of drop ejection from the liquid jet printing head 10 is arranged to be vertically downward, the bubbles developed in the common chamber 22 will be surfaced upwardly toward the common chamber 22 by the buoyancy, without affecting the liquid supply to the separate channels 20, ensuring a stable printing capability.

There can be cases where a step like ramp may exist between the heating element substrate 18 and the housing 12 due to manufacturing error of the housing 12 or assembly error for example. However, the dead water area caused by the structural nature found in the Prior Art will not be developed so that the ramp may be regarded to be tolerable.

Figure 7:
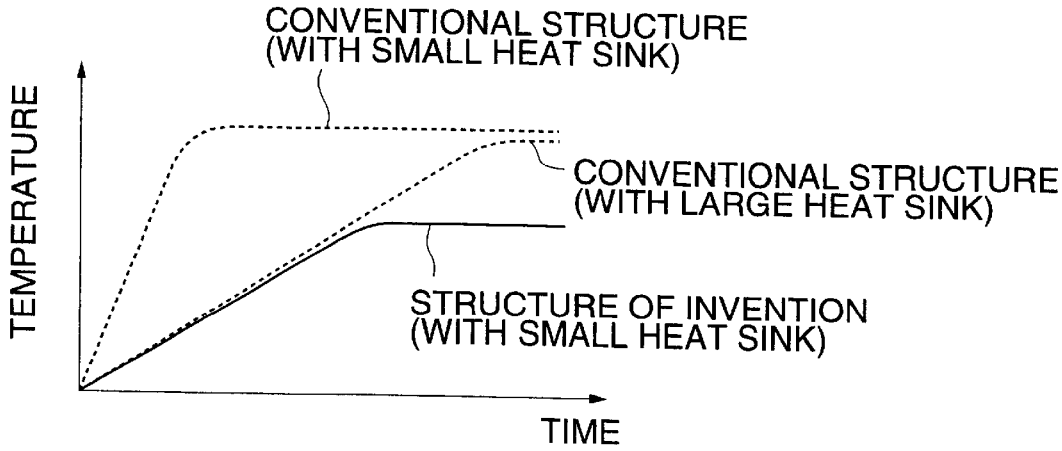
FIG. 7 is a graph depicting the temperature of a head of the Prior Art and a head in accordance with the present invention.

Another object of the present invention is to radiate excessive heat stored in the beating element substrate 18 caused by the heating of heating elements 16 not only to the heat sink 34 but also to the liquid contacting to the heating element substrate 18 by enlarging the volume of the common chamber 22. If the liquid temperature increases beyond a predetermined threshold temperature, printing failure such as sucking of bubbles from the nozzles 28 may occur. In accordance with the present invention, by sufficiently enlarging the volume of the common chamber 22, the heated liquid will move upwardly in the common chamber while cooled liquid will move downwardly. In other words a kind of convection of liquid may be created in the common chamber. The convective liquid in the common chamber may also exchange heat with the ink in the reservoir through the intermediary of a filter not shown in the figure. The saturation temperature of the head chip 14 may be accordingly significantly decreased with respect to the conventional structure. Also, since the common chamber 22 has a larger (liquid) volume therein, the increasing rate of temperature in the head chip 14 may be somewhat decelerated with respect to the conventional structure. FIG. 7 is a graph illustrating the increase of temperature in the head in accordance with the present invention as well as in the head of a conventional structure. As can be seen from the graph, the present invention may decelerate the increasing rate of temperature with the same heat sink when compared to the conventional structure, while the saturation temperature in the head may also be lowered by the heat radiation to the liquid. Thus, when using a larger heat sink in the conventional structure, the increasing rate of temperature may be equivalently slowed down, however the saturation temperature may not be decreased. In this way the present invention may avoid the printing failure by decreasing the saturation temperature, so that continuous, high-speed printing will be allowed to improve the printing productivity. In accordance with the preferred embodiment, the volume of the common chamber 22 will be approximately 2000 $mm^3$, as compared with the volume of common chamber in the chip in the conventional structure of approximately 2 $mm^3$, resulting in a volume of approximately 1000-fold. As can be clearly appreciated from the significant difference, the common chamber 22 in accordance with the present invention is drastically different from the conventional ink chamber.

Still another aspect of the present invention is to eliminate any dummy nozzles as used in the conventional structure. In the conventional structure in accordance with the Prior Art, a certain number of nozzles (for example, six to ten nozzles) are formed at the ends of the head chip, dedicated as dummy nozzles, which are not to use in printing. These nozzles were served for suppressing any printing failure caused by bubbles residing in either of both ends of common chamber and for purging bubbles by sucking. In accordance with the present invention, liquid may smoothly flow through the inlet 32 to the separate channels 20, allowing prevention of residual bubbles even in the both ends of the common chamber 22. Accordingly, dummy nozzles are basically unnecessary. As a result the head chip achievable in accordance with the present invention may become smaller while the manufacturing cost thereof may be lowered at the same time.

Figure 1B:
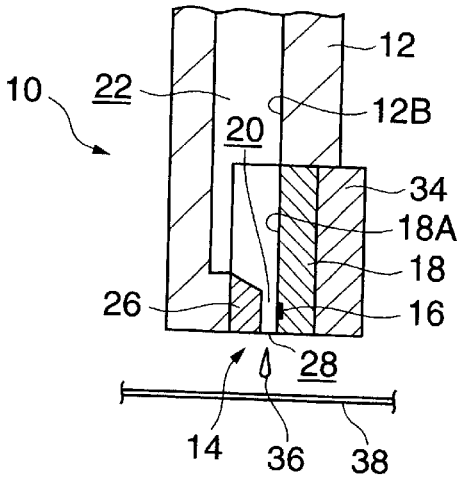
Figure 1C:
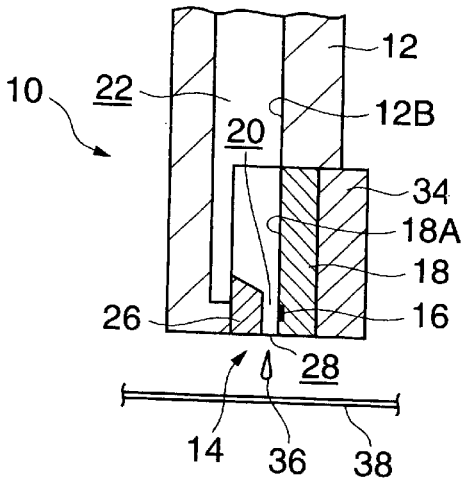

As alternative examples of the preferred embodiment, head structure as shown in FIGS. 1B and 1C may be equivalently used.

(Second Embodiment)

Now a liquid drop ejection type recording head in accordance with the second preferred embodiment of the present invention will be described in greater details hereinbelow with reference to FIGS. 4 and 6. The identical reference numerals refer to the member similar or identical to the first preferred embodiment above, so a detailed description thereof will be omitted for the sake of simplicity.

Figure 4:
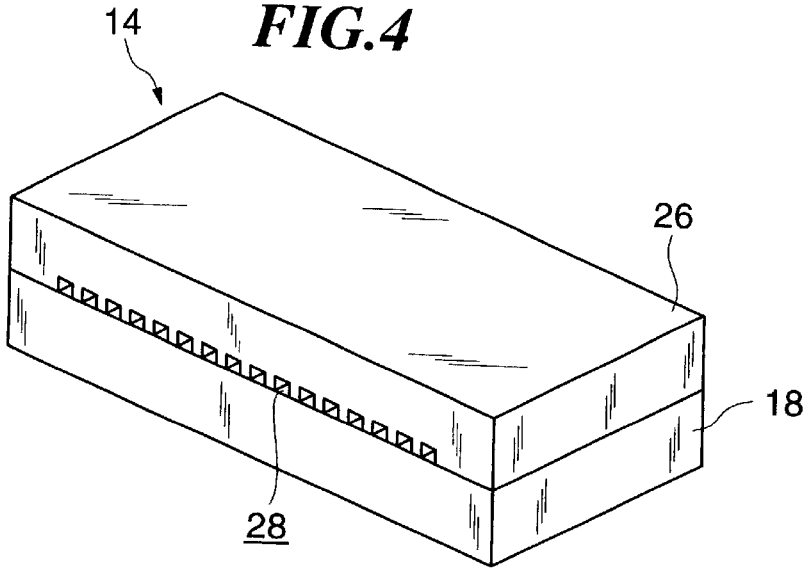
FIG. 4 is a perspective view of a head chip in accordance with a second preferred embodiment of the present invention.
Figure 5:
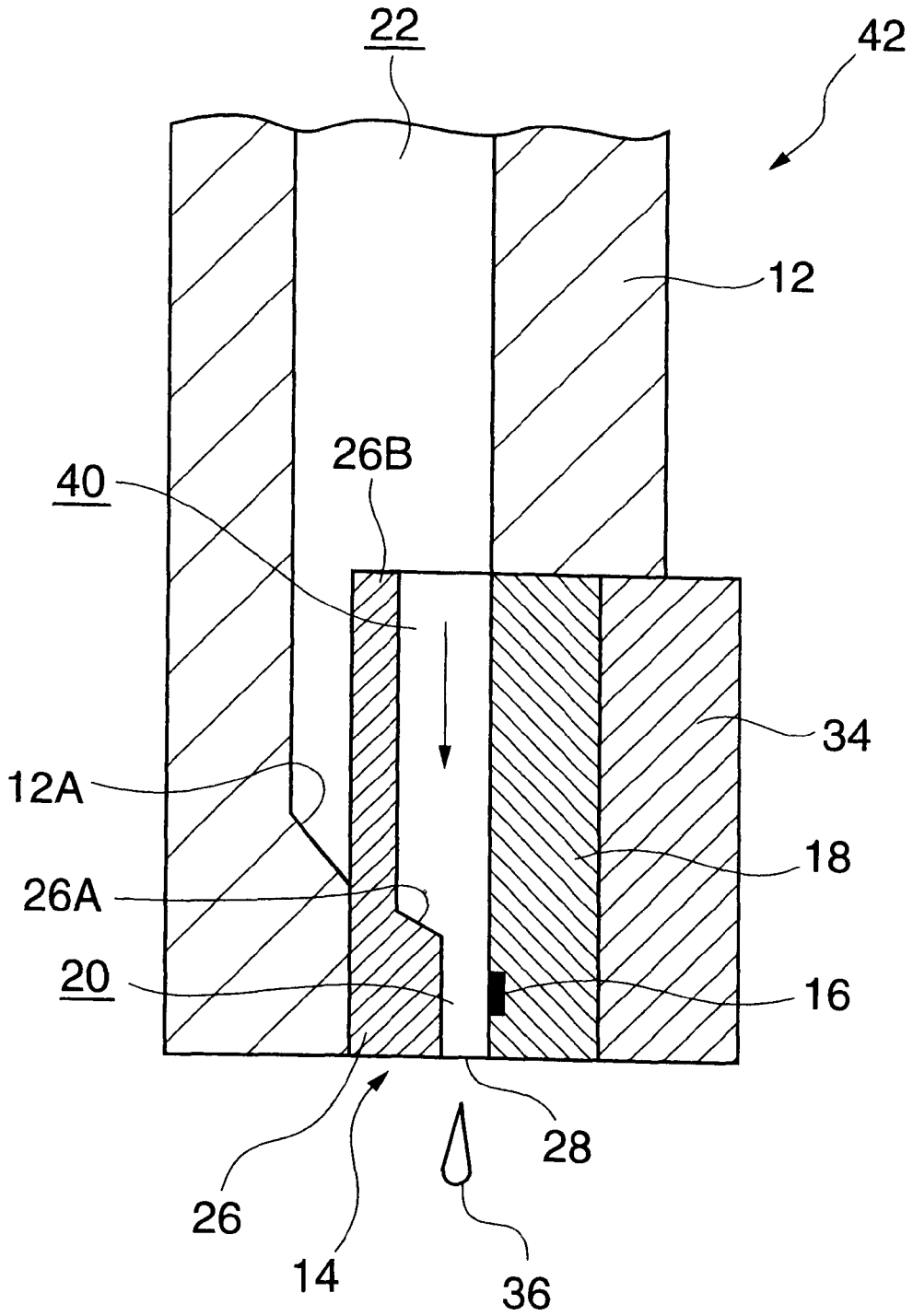
FIG. 5 is a partial cross-sectional view in the proximity of nozzles of the liquid jet printing head in accordance with the second preferred embodiment of the present invention.
Figure 6:
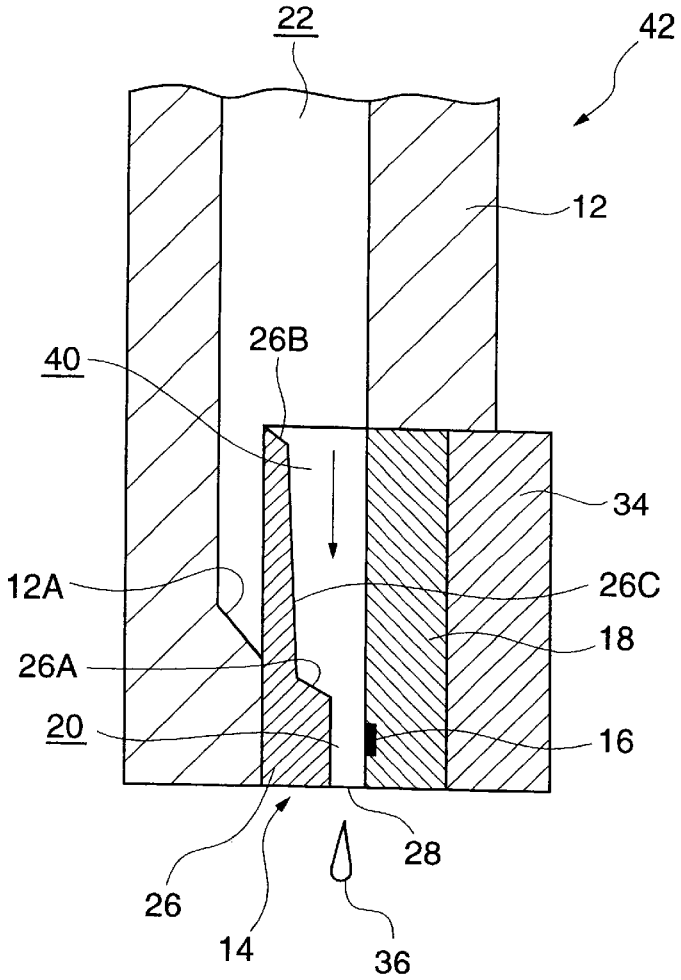
FIG. 6 is a partial cross-sectional view around the nozzles of the liquid jet printing head in accordance with another example of the second preferred embodiment of the present invention.

Now referring to the figures, FIG. 4 is a perspective view of a head chip in accordance with the preferred embodiment of the invention, FIG. 5 is a cross-sectional view of a liquid drop ejection type recording head in accordance with the preferred embodiment of the present invention, and FIG. 6 is a cross-sectional view of another embodiment in accordance with the present invention.

The liquid path substrate 26 constituting a head chip 14 as shown in FIG. 4 is different from the above mentioned first preferred embodiment in that there is no concaved recess 24. Resultingly, a guide 26B of the liquid path substrate 26 will be projected in the common chamber 22, when the head chip 14 is affixed to the housing 12. The guide 26B may be arranged to be opposed to the heating element substrate 18 to form a guided path 40 there between.

The function of thus formed drop ejection type recording head 42 will be described below.

In this drop ejection type recording head 42 having a projected guide 26B of the liquid path substrate 26 into the common chamber 22, the liquid flow introduced form the common chamber 22 through the separate channels 20 will be narrowed the inflow area (cross section) by the guided path 40 and then introduced to the separate channels 20, as well as the function similar to the above mentioned first preferred embodiment may be attained. Consequently, the guided path 40 may accelerate the flow rate of liquid as to introduce the liquid into the separate channels 20 in a more smooth way. In this manner, if bubbles are generated along with the increased temperature of liquid in the common chamber 22, the smooth flow of liquid will catch up the generated bubbles and introduced into the nozzles 28 to eject simultaneously together with the liquid drops 36, prior to growing to a size considered as printing defect. Increasing further the flow rate of liquid at the surface of the heating element substrate may also improve the radiation of heat from the substrate.

It should be noted that, as shown in FIG. 6, the surface of guide 26B opposing to the heating element substrate 18 in the drop ejection type recording head 42 may be inclined to be a slanted plane 26C the cross section of which is decreased toward the separate channels 20, for the purpose of further smooth flow.

(Third Embodiment)

Figure 8:
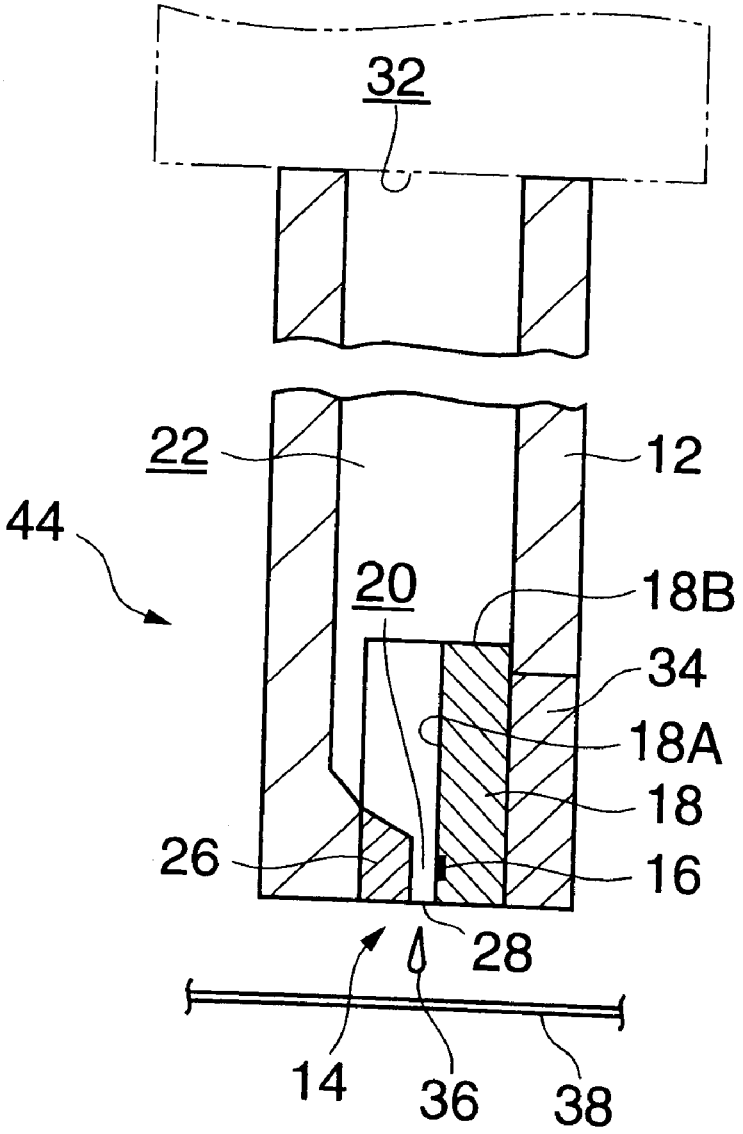
FIG. 8 is a partial cross-sectional view around the nozzles of liquid jet printing head in accordance with a third preferred embodiment of the present invention.
Figure 9:
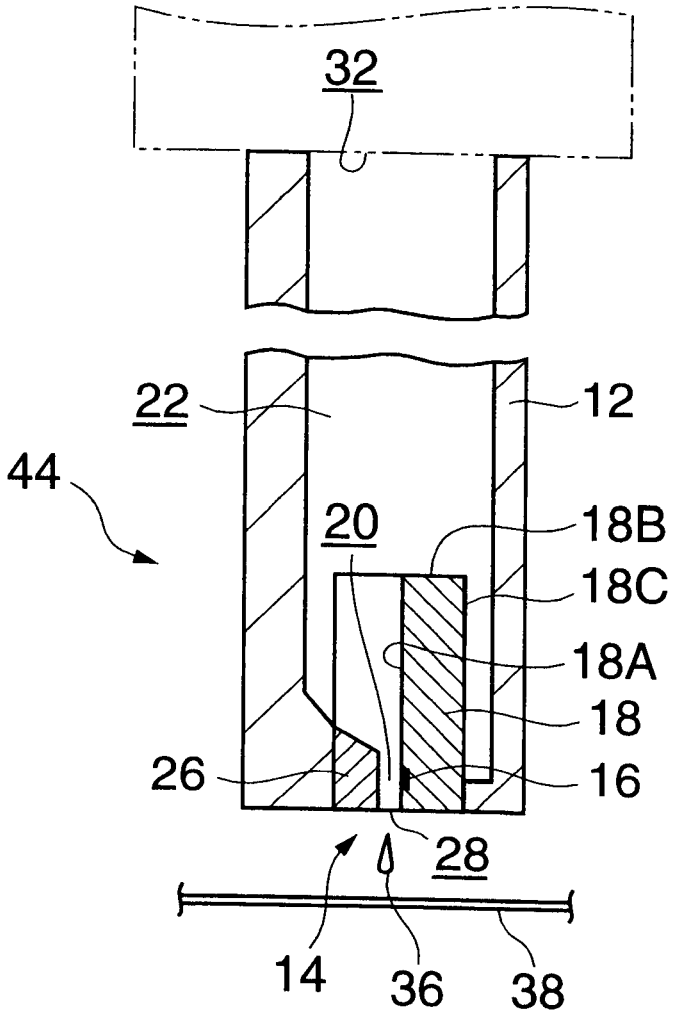
FIG. 9 is a partial cross-sectional view around the nozzles of the liquid jet printing head in accordance with another example of the third preferred embodiment of the present invention.

Next, a drop ejection type recording head in accordance with third preferred embodiment of the present invention will be described in greater details hereinbelow with reference to FIG. 8. The identical reference numerals refer to the member similar or identical to the first preferred embodiment above, so a detailed description thereof will be omitted for the sake of simplicity. FIG. 8 is a cross-sectional view of a liquid jet printing head in accordance with the third preferred embodiment of the present invention. FIG. 9 is a cross-sectional view of another example of liquid jet printing head.

The liquid drop ejection type printing head 44 in accordance with the preferred embodiment has the structure as shown in FIG. 8 with a heating element substrate 18 of the head chip 14 being housed in the housing 12 connected to the heat sink 34.

With this configuration of liquid drop ejection type printing head 44, the heating element substrate 18 may allow the liquid to come into contact not only with the surface of heating elements 18A but also with the end 18B. As a result, the heat radiation from the heating element substrate 18 to the liquid will be promoted so that the increased temperature of the heating element substrate 18 will be well controlled, allowing to improve the stability of high speed continuous printing.

The liquid drop ejection type printing head 44 may be arranged to cool the head chip 14 (heating element substrate 18) more effectively with the liquid flow by contacting the backside 18C of the heating element substrate 18 with the liquid, as shown in FIG. 9.

(Fourth Embodiment)

Figure 10:
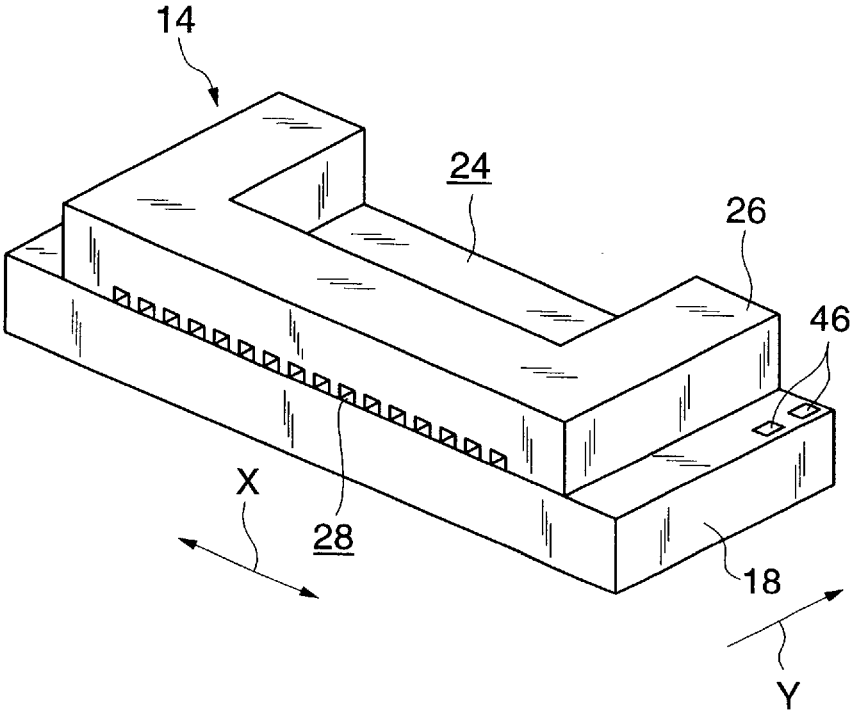
FIG. 10 is a perspective view of the head chip in accordance with a fourth preferred embodiment of the present invention.

Next, a drop ejection type recording head in accordance with fourth preferred embodiment of the present invention will be described in greater details hereinbelow with reference to FIG. 10. The identical reference numerals refer to the member similar or identical to the first preferred embodiment above, so a detailed description thereof will be omitted for the sake of simplicity. FIG. 10 is a perspective view of a head chip of liquid jet printing head in accordance with the fourth preferred embodiment of the present invention. Since the only difference from the first preferred embodiment is the head chip, this member only will be described in greater details.

The head chip 14 has terminals for electrical connection 46 for supplying power and signals to the heating elements concentrated at an end of the heating element substrate 18 in the direction of arrayed nozzles (the direction normal to the liquid drops 36 ejection, X direction of the arrow) as shown in FIG. 10.

With this configuration of head chip 14, the liquid flow from the inlet 32 to the separate channels 20 may become linear to improve the smoothness.

Figure 20:
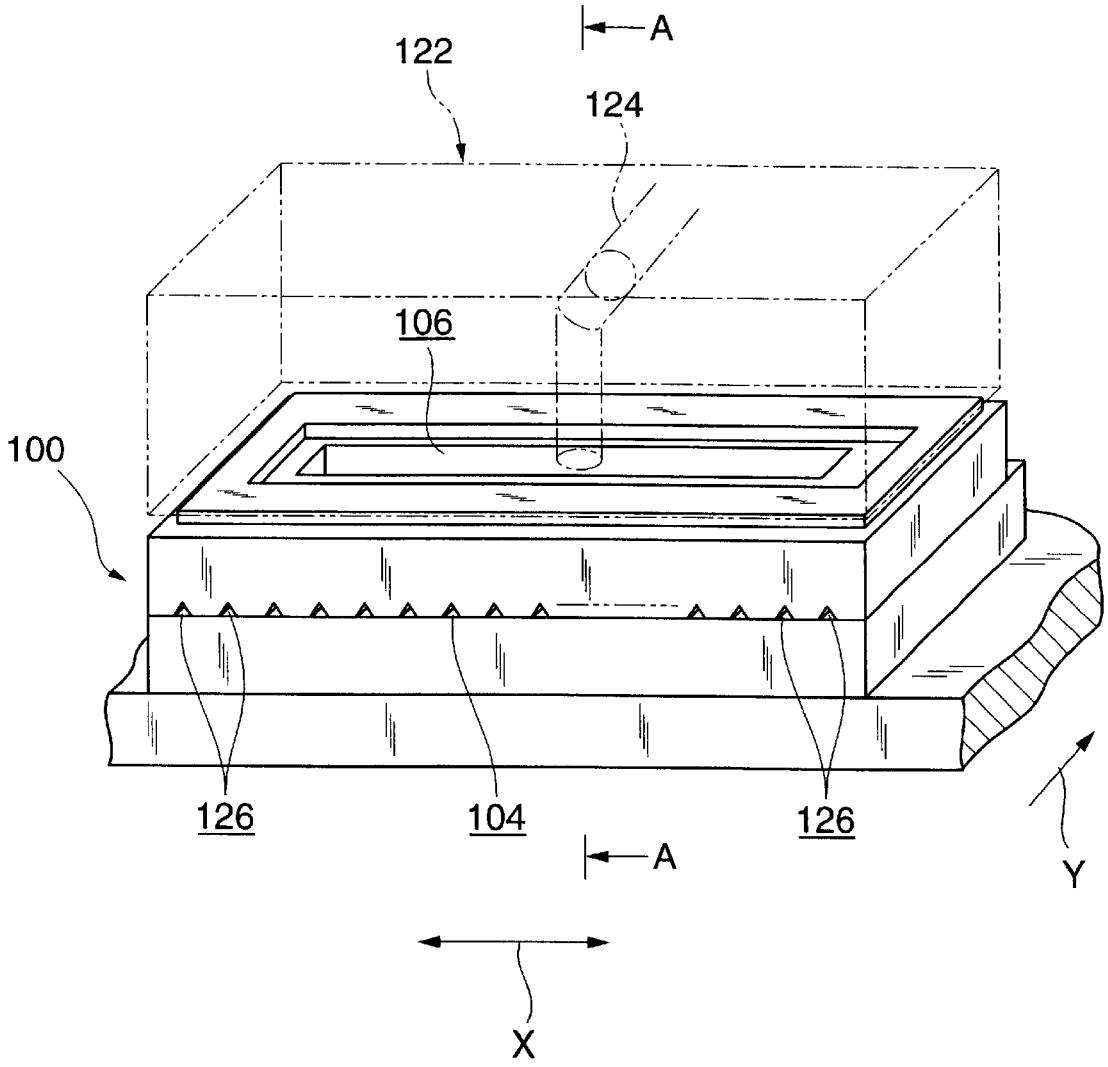
RELATED ART FIG.20
FIG. 20 is a perspective view of a liquid jet printing head in accordance with the Prior Art.
Figure 21:
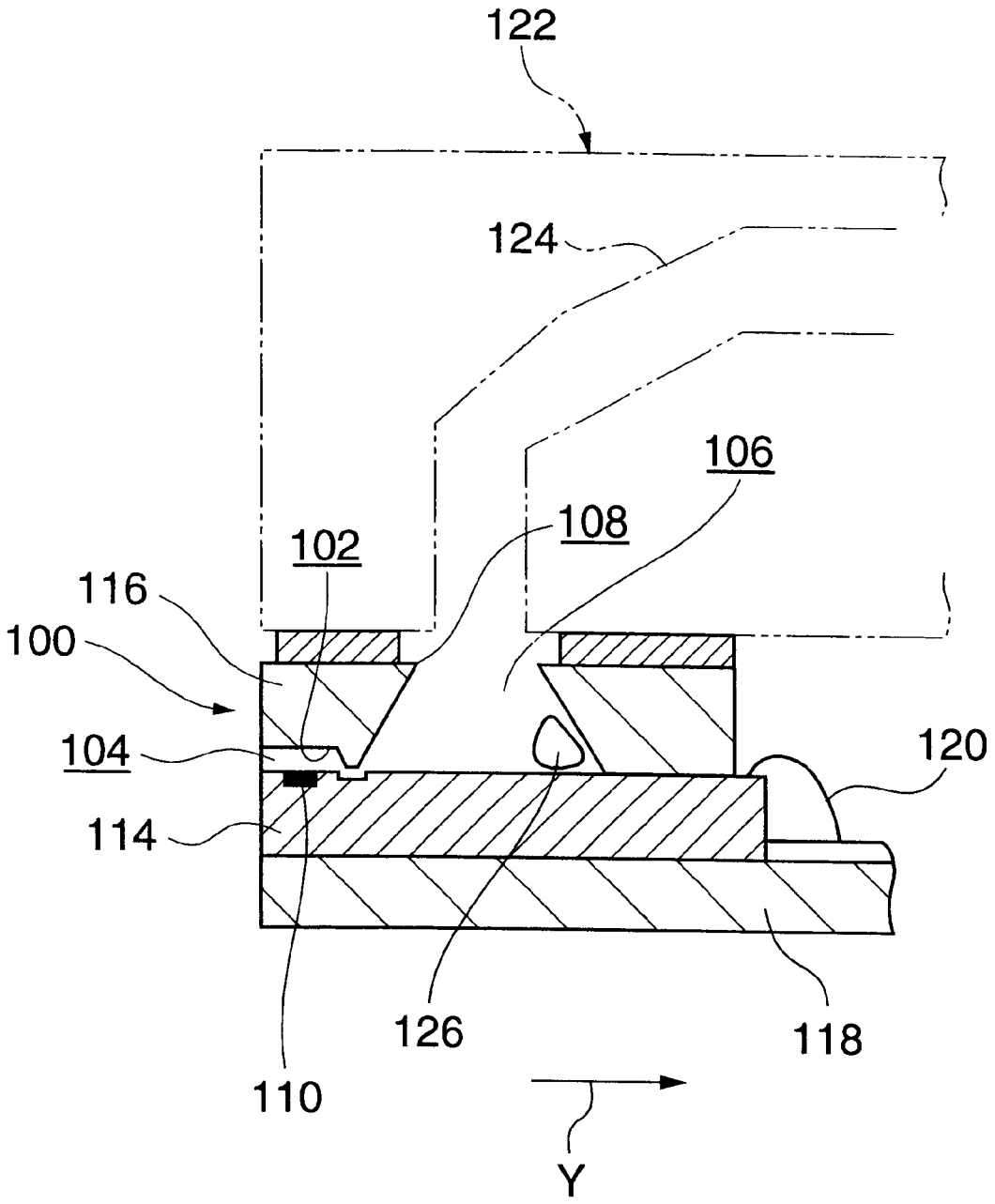
RELATED ART FIG.21
FIG. 21 is a cross-sectional view of FIG. 20 taken along with the line A—A.

In the conventional liquid jet printing head, the signal terminals were disposed at the back end of the heating element substrate (see Y direction of the arrow in FIG. 20 and FIG. 21). Since the flow path had to be designed so as to detour the terminals, the common chamber was a meandering path, which caused the residual bubbles. On the other had, in the liquid jet printing head 10 in accordance with the present invention, the terminals 46 are concentrated to a location at an edge of the heating element substrate 18, perpendicular to the flow (direction of drop ejection). This configuration allows to supply the liquid to the separate channels 20 in the shortest and linear path without blocking the flow and to minimize the potentially residual bubbles.

(Fifth Embodiment)

Figure 11:
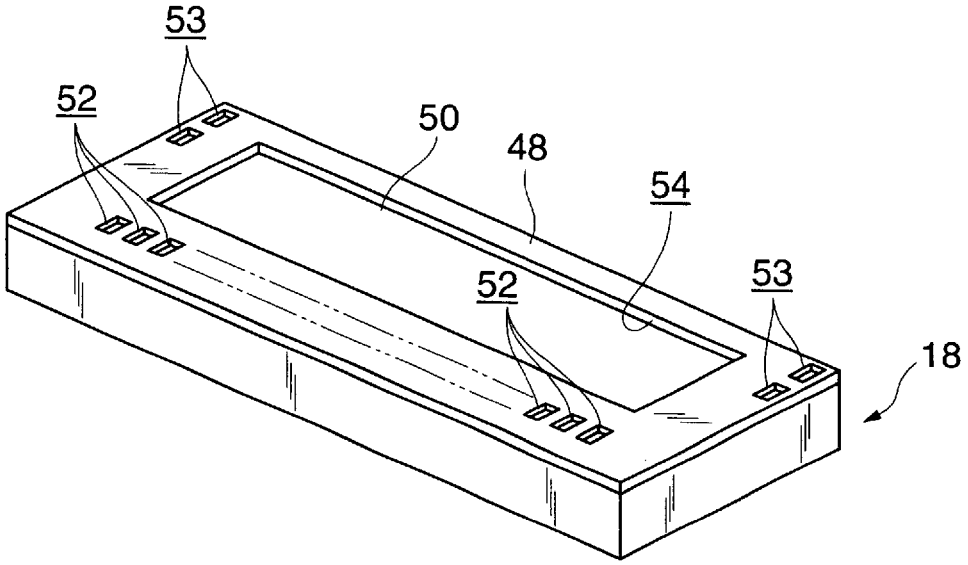
FIG. 11 is a perspective view of the heating element substrate in accordance with a fifth preferred embodiment of the present invention.

Next, a drop ejection type recording head in accordance with fifth preferred embodiment of the present invention will be described in greater details hereinbelow with reference to FIG. 1A and FIG. 11. The identical reference numerals refer to the member similar or identical to the first preferred embodiment above, so a detailed description thereof will be omitted for the sake of simplicity. FIG. 11 is a perspective view of a head chip of liquid jet printing head in accordance with the fifth preferred embodiment of the present invention.

As shown in FIG. 11, at the topmost layer of the heating element substrate 18, a resin layer 48 is deposited as a protector film against the liquid. Immediately beneath the resin layer 48 is deposited a tantalum layer 50, which is a high thermal conductive material for promoting the heat radiation from the heating element substrate 18. The resin layer 48 provides holes 52 and 53 each for respective part of heating elements 16 and terminals 46 on the heating element substrate 18, and an opening 54 formed in the part facing to the common chamber 22. In this configuration, when the head chip 14 is affixed to the housing 12, the liquid contained in the common chamber 22 will directly contact the tantalum layer 50.

The function of thus configured liquid drop ejection type printing head (heating element substrate 18) will be described below.

The temperature of the heating element substrate 18 will be gradually augmented by supplying continuous power to the heating elements 16 for ejection of liquid drops 36. Furthermore, the increasing rate of temperature in the heating element substrate 18 will be larger for example in case wherein the heating element substrate 18 integrates the heating elements 16 with a peripheral circuitry, the circuitry itself generates heat by driving, in addition to the heating elements.

This preferred embodiment is intended to achieve supplemental heat radiation to the liquid in addition to the heat radiation of the heating element substrate 18 to the atmosphere by means of a heat sink 34 made of such material as aluminium. By enlarging the area of heating element substrate 18 in contact with the liquid and disposing the tantalum layer 50, which is a high thermal conductive material, on the contacting portion, the efficiency of heat radiation to the liquid is improved.

Consequently, the heat sink 34, which limited the size of head chip 14, may be smaller, resulting in both the liquid jet printing head and the apparatus of a smaller size and lightweight.

(Sixth Embodiment)

Figure 12:
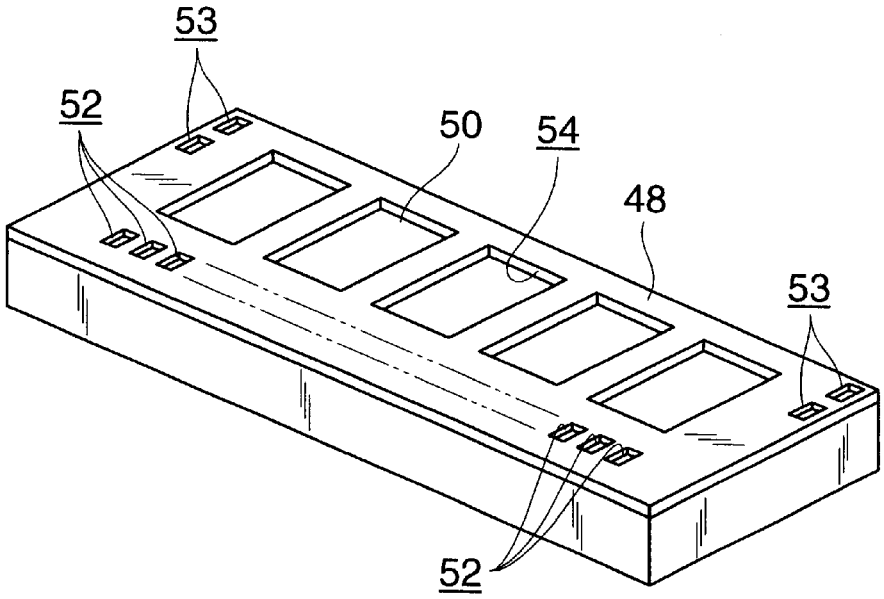
FIG. 12 is a perspective view of the heating element substrate in accordance with a sixth preferred embodiment of the present invention.

Next, a drop ejection type recording head in accordance with sixth preferred embodiment of the present invention will be described in greater details hereinbelow with reference to FIG. 1A and FIG. 12. The identical reference numerals refer to the member similar or identical to the first and sixth preferred embodiments above, so a detailed description thereof will be omitted for the sake of simplicity. FIG. 12 is a perspective view of a head chip of liquid jet printing head in accordance with the sixth preferred embodiment of the present invention.

In the fifth embodiment, a single large opening 54 was formed in the resin layer 48 at the position exposing the heating element substrate 18 to the common chamber 22. In the sixth embodiment, plural smaller openings 54 will be formed.

When forming the opening 54 as one single opening as is the case of the fifth embodiment, the efficiency of heat radiation may be maximized. However, there may arise a problem of the precision of opening or flatness in the process step of piercing the polyimide or flattening the resin layer 48, caused by the large size of opening 54, if the resin layer 48 is flattened by chemical mechanical polishing (CMP) or the like. When configuring a number of openings 54, as shown in FIG. 12, made by an individually separated etching pattern of the resin layer 48, the heat radiation from the heating clement substrate to the liquid may be ensured, without a problem in manufacturing.

More specifically, the manufacturing problem will be described by way of example when forming a single large opening in the resin layer. In the process of CMP, abrasive particles called slurry are used. When a large opening is formed in the resin layer, some slurry may be accumulated in the opening. The polishing rate (the speed of polishing) in the proximity of the large opening will be faster than any other part. It may be difficult to flatten the entire surface due to the difference in polishing rate. Splitting the opening to plural openings will be effective for solving the problem as have been described above.

Figure 13:
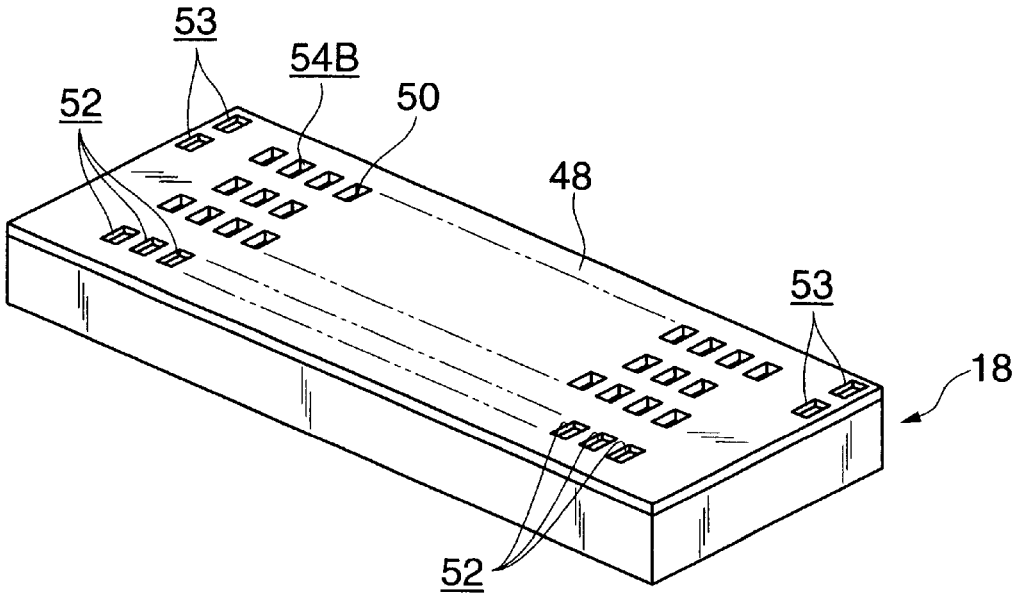
FIG. 13 is a perspective view of a heating element substrate in accordance with another example of the sixth preferred embodiment of the present invention.

Preferably, as shown in FIG. 13, the split openings 54B may be the approximately same size as the hole 52 at the location of heating elements, distributed vertically and horizontally at a predetermined interval space, and arranged to be staggered by displacing an array by a half span of the hole pitch. This configuration will further improve the flatness of the liquid jet printing head 10 in the course of manufacturing.

(Seventh Embodiment)

Figure 14:
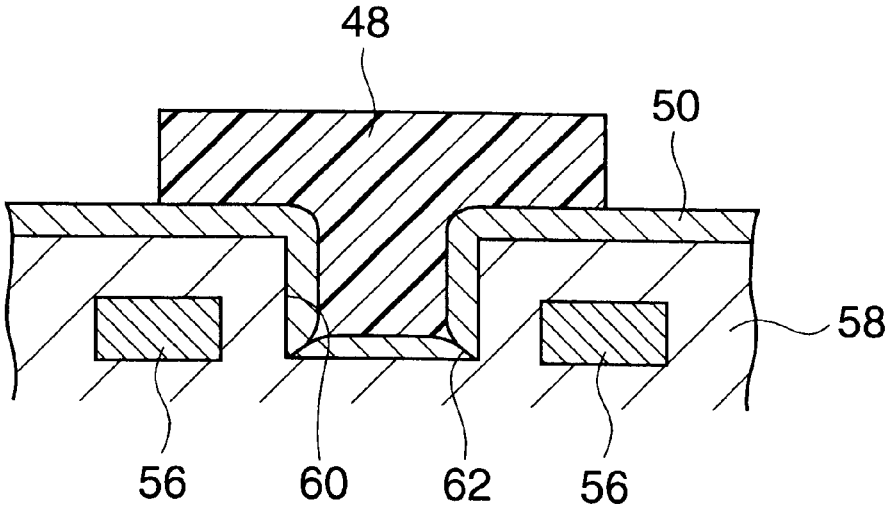
FIG. 14 is a cross-sectional view illustrating a resin layer defined in a heating element substrate in accordance with a seventh preferred embodiment of the present invention when the coating with tantalum is weak.

Next, a drop ejection type recording head in accordance with the seventh preferred embodiment of the present invention will be described in greater details hereinbelow with reference to FIG. 1A and FIG. 14. The identical reference numerals refer to the member similar or identical to the first, fifth and sixth preferred embodiments above, so a detailed description thereof will be omitted for the sake of simplicity. FIG. 14 is a schematic diagram illustrating the deposition of resin layer on the top of heating element substrate. The only difference from the fifth and sixth embodiments is the deposition of resin layer, this member only will be described.

On the heating element substrate, as shown in FIG. 14, aluminium wirings 56 will be formed. A protection layer 58 of silicon nitride deposited by means of for example plasma CVD method may be formed for providing a step 60. A tantalum layer 50 will be uniformly deposited on top of the protection layer 58. Thereafter, on the step 60 exceeding a reference value, a resin layer liquid jet printing head 10 will be deposited as shown in FIG. 14.

In case where the distance of the step 60 exceeds the reference value, there may probably be a portion 62 on which the tantalum layer 50 is not uniformly deposited at a predetermined thickness (referred to as defect of deposition hereinafter). If liquid is in contact with such defect of deposition 62 for longtime, the liquid may penetrate into inside of substrate through the defect of deposition 62 to corrode aluminium wirings 56 and the like to, ultimately, cause a failure of the head chip, in the worst case. Therefore, the heating element substrate 18 may be securely protected against the liquid by providing a resin layer liquid jet printing head 10 in advance at the step 60 exceeding a threshold value at which the defect of deposition 62 is likely to develop.

(Eighth Embodiment)

A liquid jet printing head in accordance with the eighth embodiment of the present invention will be described below in greater details. This embodiment is characterized in particular by the deposition of tantalum, which will be described among portions in question.

Figure 15:
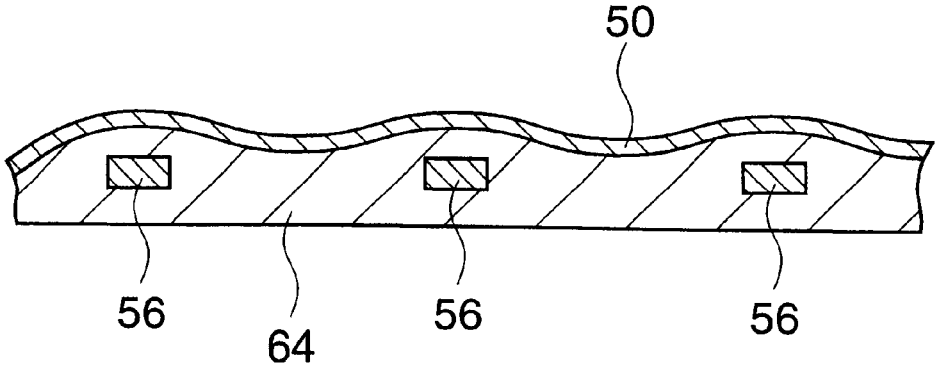
FIG. 15 is a schematic diagram of tantalum layer defined on a heating element substrate in accordance with an eighth preferred embodiment of the present invention.

In this preferred embodiment, a rough surface of the protection layer 58 deposited on the heating element substrate 18 may be formed before depositing the tantalum layer 50, a high thermal conductive material, on the rough surface. For example, as shown in FIG. 15, this embodiment may make use of ramps made by the aluminium wirings 56 to form thereon a smooth and wavy passivation layer 64 of silicon nitride (deposited for example by means of an atmospheric pressure CVD method) to deposit further thereon a tantalum layer 50.

In this configuration, the deposited area (surface area) of the tantalum layer 50 may be increased to further efficiently promote the heat radiation of the heating element substrate 18 through the tantalum layer 50 to the liquid.

It may be preferable on the other hand to integrate, in the heating element substrate 18 shown in FIGS. 1 to 15, the heating elements 16 and the driver circuits (not shown in the figure) driving these heating elements 16. For example, if there are 160 heating elements 16, signal wirings and connection terminals for each of these 160 heating elements 16 will be required. If the driver circuits for these 160 heating elements 16 are integrated in the heating elements 16 at the time when the heating elements 16 are formed on the substrate 18, the number of connection terminals may be decreased to approximately 30 or less, resulting in the shrinkage of the head chip 14, decrease of bonding wires for communicating signals with external devices, as well as electrically high reliability of the head at the same time.

(Ninth Embodiment)

Figure 16A:
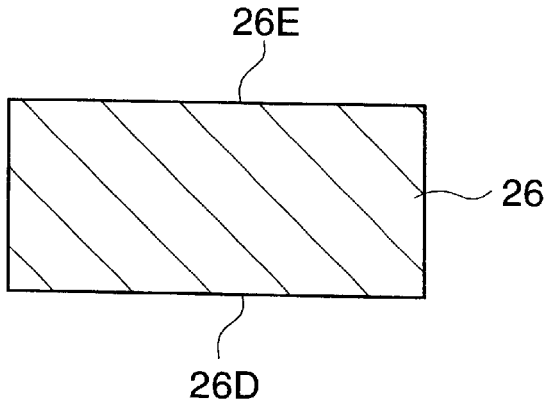
FIGS. 16A to 16C arc schematic diagrams illustrating the method of manufacturing a head chip in accordance with a ninth preferred embodiment of the present invention.
Figure 16B:
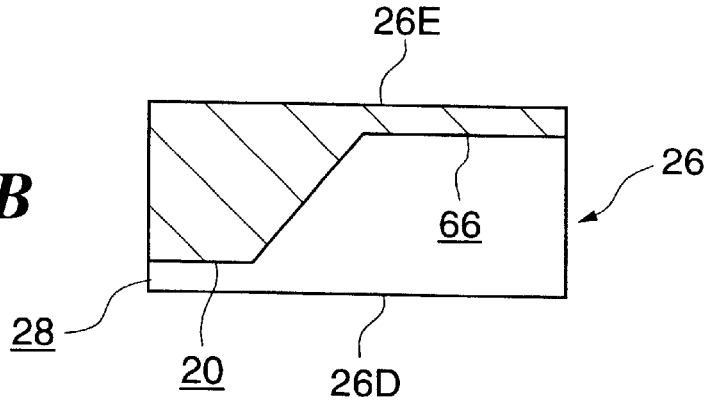
Figure 16C:
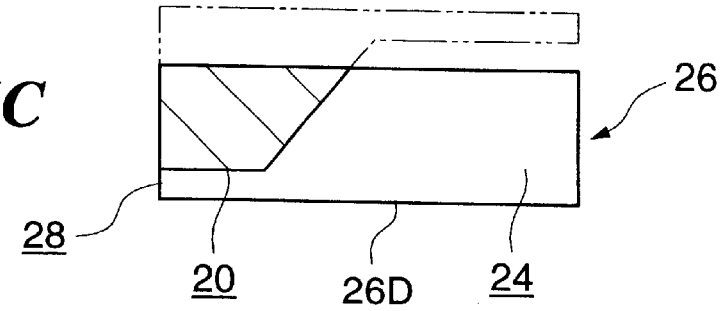

A preferred example of the method of manufacturing the path substrate used in the liquid jet printing head in accordance with the first embodiment above will be described below in greater details. The manufacturing method in accordance with this preferred embodiment, nozzles 28 and unpierced grooves 66 may be formed (see FIG. 16B) on the nozzle forming surface 26D (see FIG. 16A) of the liquid path substrate 26 by means of the method disclosed in Japanese Published Unexamined Patent Application No. H11-227208. Although in Japanese Published Unexamined Patent Application No. H11-227208 grooves are to be pierced, grooves may be formed unpierced by the control of duration of etching. Thereafter, as shown in FIG. 16C, the backside 26E of the path substrate (i.e., the side opposed to the nozzle forming side) will be processed (grinding, polishing, etching and the like) to expose (form) a groove 24 which may be part of the common chamber 22 (the groove may sometime be referred to as chamber groove).

The chamber groove 24 may be in general formed prior to the process of nozzles 28 (separate channels 20), so that care should be taken when handling the liquid path substrate 26 which has the chamber groove 24 previously formed, otherwise the substrate may be damaged. In accordance with this preferred embodiment, the potential risks of defect of substrate may be avoided by piercing the common chamber as the final process of the path substrate by for example grinding, after shaping the nozzles 28 (separate channels 20) and the like.

In the manufacturing method as have been described above, when piercing the chamber groove 24 on the liquid path substrate 26 with no support the substrate may have insufficient strength. The liquid path substrate 26 may be broken while processing in the worst case.

When using the processing method of the substrate as disclosed in Japanese Published Unexamined Patent Application No. H11-227208, if a (large) throughhole is pierced prior to process nozzles, the cooling gas for nozzle shaping (RIE) may be leaked from the back side 26E of the path substrate through the pierced throughhole to the nozzle forming side 26D to degrade the quality and precision of nozzles. Therefore, the throughhole will be opened by thinning (for example, grinding, polishing, etching and the like) the thickness of substrate from the back side 26E thereof after the formation of nozzle, with no throughhole pierced at the time of forming nozzles. In this manner, the quality and precision of nozzle shaping may be ensured.

Figure 17:
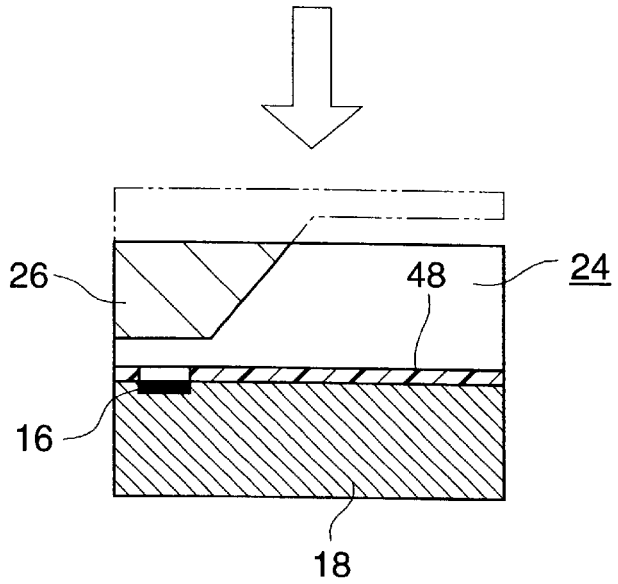
FIG. 17 is a cross-sectional view of a head chip illustrating the method of manufacturing a head chip in accordance with the ninth preferred embodiment of the present invention.

In order to improve the ease of handling of liquid path substrate 26, as shown in FIG. 17, the process step of recession of the back side 26E of the path substrate (for example by grinding) may be provided after the bonding with the heating element substrate 18. When bonding the path substrate with the heating element substrate, the failure of liquid path substrate 26 may be avoided since the heating element substrate 18 may be served as a support when forming the chamber groove (throughhole) 24 on the liquid path substrate 26.

If a process such as grinding or polishing is performed after bonding the liquid path substrate 26 with the heating element substrate 18, there may arise another risk of clogging of separate channels 20 with swarf causing a failure of ejection of liquid drops 36. Although it is possible to rinse several times after polishing the liquid path substrate 26, the number and time of steps increases as well as the clogging may not be removed.

Then, the failure may be avoided by for example filling the separate channels 20 with some resin, preferably negative resist, through a predefined filler opening to prevent the penetration of swarf into the separate channels 20. The filled resin can be removed with a remover solution after polishing, or with a developing fluid if negative type resist is used.

(Tenth Embodiment)

A representative example of liquid jet printing head in accordance with any one of the preferred embodiments described above combined with a liquid supplying apparatus will be described below.

Figure 18:
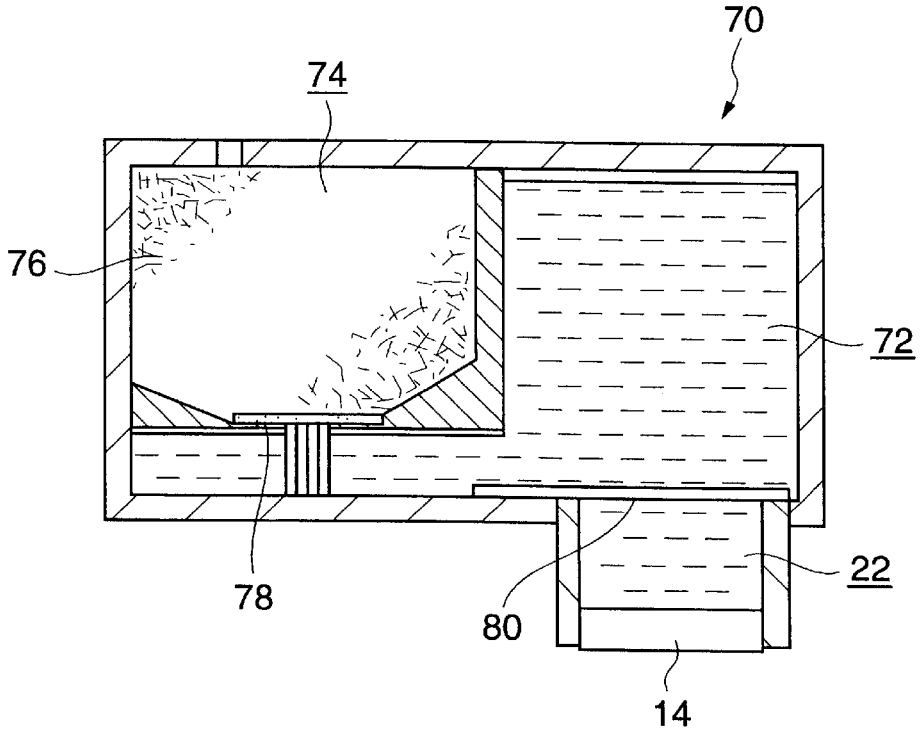
FIG. 18 is a cross-sectional view of a head structure combined with a liquid reservoir in accordance with an embodiment of the present invention.

A liquid supplying apparatus 70 may include, as shown in FIG. 18, a first reservoir 72, which holds liquid with a free surface, and a second reservoir 74, which supplies liquid to the first reservoir 72 while controlling the negative pressure applied to the first reservoir 72. The second reservoir 74 incorporates a porous member 76 impregnated with the liquid and opened to the atmosphere, communicating to the first reservoir 72 through a meniscus member 78.

At the bottom, the first reservoir 72 is connected to the common chamber 22 through a filter 80. Warmed liquid by the heating element substrate 18 may be thereby circulated by convection from the common chamber 22 to the first reservoir 72 and vice versa through the filter 80 to promote the heat radiation of heating element substrate 18 more effectively.

(Eleventh Embodiment)

Figure 19:
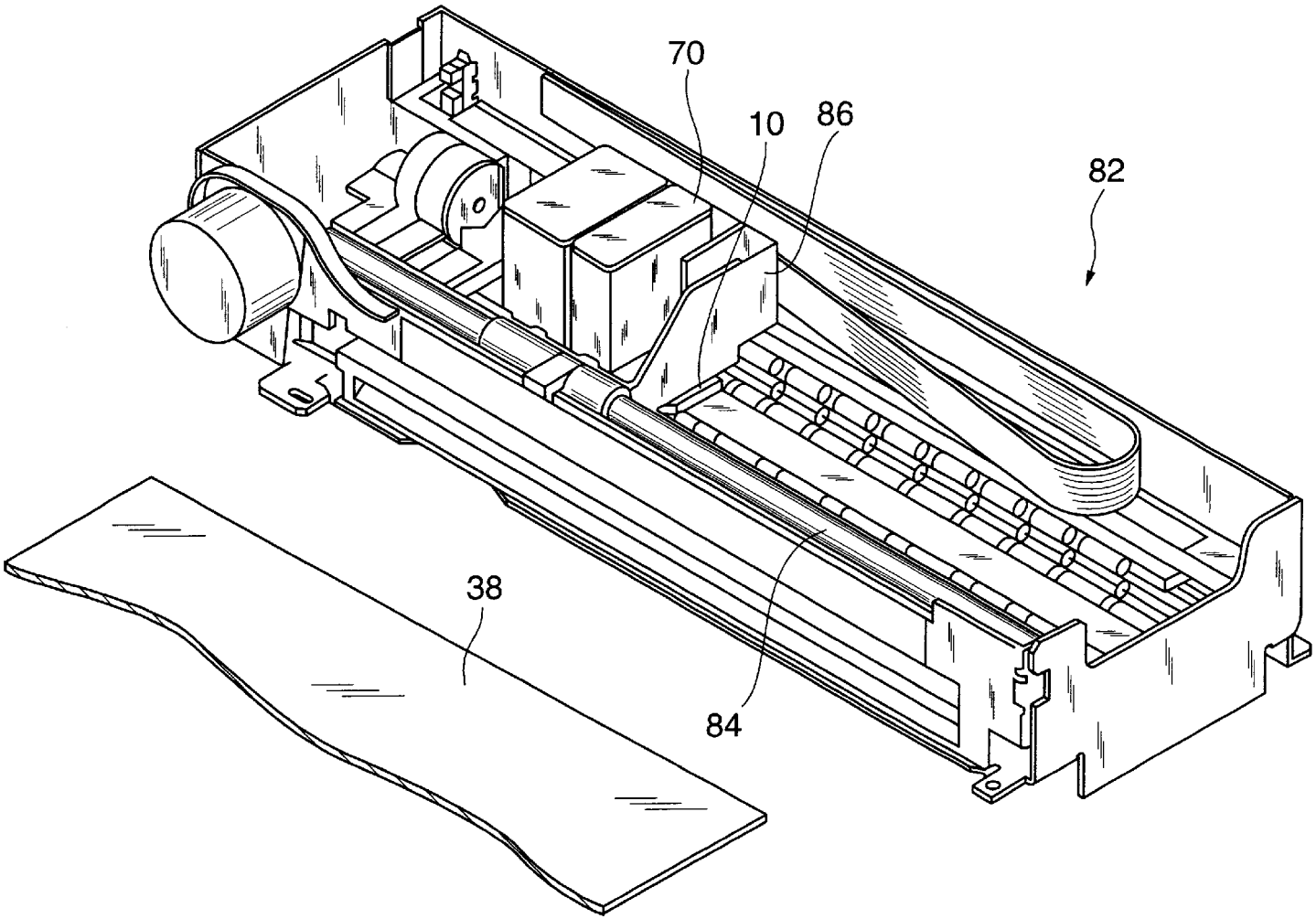
FIG. 19 is a perspective view of a liquid jet printing apparatus incorporating a liquid jet printing head in accordance with one of preferred embodiments of the present invention.

Now referring to FIG. 19, there is shown a perspective view of an exemplary liquid jet printing apparatus incorporating a liquid jet printing head in accordance with any one of the preferred embodiments as have been described above.

The liquid jet printing apparatus 82 incorporates a liquid dispenser 70 and a liquid jet printing head 10 (which head is not limited to the head described above in the first embodiment), both mounted on a carriage 86 slidably mounted on a guide shaft 84.

The liquid jet printing head 10 may be arranged in the liquid jet printing apparatus 82 so as to direct the ejection of liquid drops from the liquid jet printing head 10 to the gravity direction or within the range of approximately 45 degrees from the gravity direction to displace bubbles remaining in the separate channels 20 and the common chamber 22 upwardly to separate from the proximity of separate channels 20 to prevent positively the printing failure due to bubble clogging.

The recordable medium 38 may be of any recordable medium including for example paper sheets, post cards, fabrics, and the like. The recordable medium 38 will be transported to the position facing to the liquid jet printing head 10 by a carrier mechanism.

Although in the above description there has been depicted and described the liquid jet printing head 10 with only one single common chamber 22, the present invention is not limited thereto. For example, a configuration for color by integrating one head for one color may be devised within the scope of the present invention. If there are some common chambers each dedicated for a color, each chamber may incorporate respectively a sub-reservoir.

In conclusion, the liquid jet printing head and liquid jet printing apparatus in accordance with the present invention may prevent bubbles from residing in the common chamber or in the separate channels, and decrease the temperature of heating element substrate to enable stable, high speed, and continuous ink drop ejection (printing). Also a method of manufacturing a liquid jet printing head in accordance with the present invention may produce a printing head at higher precision.

What is claimed is:

1. A liquid jet printing head for jetting liquid by heating with a heating member, the liquid jet printing head comprising:

a common liquid chamber having an inlet opening for supplying liquid from outside;

a heating element substrate having plural heating elements thereon;

plural separated channels for introducing liquid supplied through the common liquid chamber to the heating elements to eject the liquid through outlets; and a guide plate for narrowing a cross section of a path toward the channels, wherein the liquid supplied from the inlet flows through linearly to the outlet, and the heating element substrate is arranged along with the flow direction of the liquid.

2. The liquid jet printing head according to claim 1, wherein a guiding surface is provided for driving the liquid that flows through the common liquid chamber to the separate channels.

3. The liquid jet printing head according to claim 1, wherein the cross section of the path formed by the guide plate and the substrate is gradually diminished in the direction toward the separate channels.

4. The liquid jet printing head according to claim 1, wherein the heating element substrate is arranged so as to contact with the liquid on a surface other than that of the surface having the heating elements.

5. The liquid jet printing head according to claim 1, wherein the respective separate channels directly communicate with the common liquid chamber.

6. The liquid jet printing head according to claim 1, further comprising input/output terminals of electric signal on the surface of the heating element substrate, wherein the terminals are positioned near an end of the heating element substrate in a direction perpendicular to the liquid jet direction.

7. The liquid jet printing head according to claim 1, the heating elements comprising:

a liquid-resistant thermal conductive material deposited on the surface of the heating element substrate; and a resin layer deposited on the surface of the heating elements such that a part of the thermal conductive material is exposed to the liquid.

8. The liquid jet printing head according to claim 7, wherein the resin layer defines a plurality of openings so that the thermal conductive material is partially exposed to the liquid.

9. The liquid jet printing head according to claim 8, wherein the openings are of the same shape.

10. The liquid jet printing head according to claim 9, wherein the openings are arranged in a staggered pattern.

11. The liquid jet printing head according to claim 7, wherein the liquid-resistant high thermal conductive material is disposed on the surface of the heating element substrate to provide a wavy ramp surface.

12. The liquid jet printing head according to claim 11, wherein the ramp of the high thermal conductive material exceeding a reference value is coated with the resin layer.

13. A liquid jet printing apparatus comprising a liquid jet printing head according to claim 1.

14. The liquid jet printing apparatus according to claim 13, wherein the liquid jet printing head is arranged so as to jet liquid in the angular range between the gravity direction and up to 45 degrees with respect to the gravity direction.

15. A method of manufacturing the liquid jet printing head according to claim 1, wherein the plural separate channels are defined by a silicon substrate, both the separate channels and the common liquid chamber are formed either by a crystalline anisotropic etching method or an anisotropic etching method of the silicon substrate.

16. The method of manufacturing the liquid jet printing head according to claim 15, comprising:

a first step of etching a first surface of the silicon substrate to provide grooves forming a portion of the separate channels and the common liquid chamber; and a second step of processing the substrate from a second surface opposing the first surface to decrease the thickness of the substrate to pierce therethrough the groove for a portion of the common liquid chamber.

17. The method of manufacturing the liquid jet printing head according to claim 16, wherein the second process step is performed after bonding the silicon substrate and the heating element substrate.

18. The method of manufacturing the liquid jet printing head according to claim 15, the method further comprising the step of:

forming a driver circuit of the heating element with the heating element on the surface of the heating element substrate by a semiconductor manufacturing technique.

19. A liquid jet printing head for jetting liquid by heating with a heating member, the liquid jet printing head comprising:

a common liquid chamber having a wall portion on which a liquid flows;

an inlet opening for supplying liquid from outside;

an outlet opening; and a print head chip having a heating element substrate and a channel substrate, the print head being mounted in the common liquid chamber near the outlet opening, wherein the wall portion and the heating element substrate are coupled such that liquid supplied from the inlet flows through linearly to at least one heating element.

20. The liquid jet printing head according to claim 19, wherein a cross section of a path formed by the heating element substrate and the channel substrate is gradually diminished in a direction toward the outlet opening.

21. The liquid jet printing head according to claim 19, wherein a channel formed by the heating element substrate and the channel substrate directly communicates with the common liquid chamber.

22. The liquid jet printing head according to claim 19, further comprising input/output terminals of electric signal on the surface of the heating element substrate, wherein the terminals are positioned near an end of the heating element substrate in a direction perpendicular to the liquid jet direction.

23. The liquid jet printing head according to claim 19, the at least one heating element comprising:

a liquid-resistant thermal conductive material deposited on the surface of the heating element substrate; and a resin layer deposited on the surface of the at least one heating element such that a part of the thermal conductive material is exposed to the liquid.

24. The liquid jet printing head according to claim 23, wherein the resin layer defines a plurality of openings so that the thermal conductive material is partially exposed to the liquid.

25. The liquid jet printing head according to claim 24, wherein the openings are of the same shape.

26. The liquid jet printing head according to claim 25, wherein the openings are arranged in a staggered pattern.

27. The liquid jet printing head according to claim 23, wherein the liquid-resistant high thermal conductive material is disposed on the surface of the heating element substrate to provide a wavy ramp surface.

28. The liquid jet printing head according to claim 27, wherein the ramp of the high thermal conductive material exceeding a reference value is coated with the resin layer.

* * * * *